US007954669B2

(12) United States Patent
VanGordon et al.

(10) Patent No.: US 7,954,669 B2
(45) **Date of Patent: *Jun. 7, 2011**

(54) CONTAINER WITH ENHANCED DISPLAY

(75) Inventors: Todd VanGordon, Basking Ridge, NJ (US); Van Canady, Princeton, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/715,808

(22) Filed: Mar. 2, 2010

(65) Prior Publication Data

US 2010/0155418 A1 Jun. 24, 2010

Related U.S. Application Data

(63) Continuation of application No. 11/157,517, filed on Jun. 21, 2005, now Pat. No. 7,690,531.

(51) Int. Cl.
*B05B 11/00* (2006.01)

(52) U.S. Cl. ..... 222/78; 222/321.7; 222/321.9; 222/464.1; 40/310; 40/427

(58) Field of Classification Search ..... 222/321.9, 222/382, 383.1, 464.1, 78, 321.7; 40/310, 40/406, 409, 427, 439, 738; 463/30–33
See application file for complete search history.

(56) References Cited

U.S. PATENT DOCUMENTS

| | | | | |
|---|---|---|---|---|
| 2,305,890 | A | 12/1942 | Hudson | |
| 3,300,367 | A | 1/1967 | Swartz | |
| 5,803,788 | A | 9/1998 | Penberthy et al. | |
| 5,915,600 | A | 6/1999 | Bitton | |
| 5,937,554 | A | 8/1999 | Haugk et al. | |
| 6,006,958 | A | 12/1999 | Bitton | |
| 6,065,640 | A | 5/2000 | Ho et al. | |
| 6,073,373 | A | 6/2000 | Haugk et al. | |
| 6,233,856 | B1 | 5/2001 | Haugk et al. | |
| 6,276,566 | B1 | 8/2001 | Zaksenberg | |
| 6,641,478 | B2 | 11/2003 | Sakai | |
| 7,690,531 | B2 * | 4/2010 | VanGordon et al. | 222/78 |
| 2001/0043467 | A1 | 11/2001 | Carpenter et al. | |

* cited by examiner

*Primary Examiner* — Frederick C. Nicolas
(74) *Attorney, Agent, or Firm* — Judy W. Chung

(57) ABSTRACT

This invention is directed to a decorated dispensing container. The container is substantially transparent and has a decoration on the front and/or rear surface. The dispensing unit comprises a pump mechanism with a dip tube at one end and a dispensing channel at the other end. The dip tube has an identifiable shape formed in the dip tube. This identifiable shape can be a land, sea or air animal, or an inanimate object. Colors are applied to the identifiable shape by hand painting or the use of a shrink label or an in mold label. By the use of a decorated identifiable shape and a coordinating label on the front and/or rear surface of the container a 3-D effect is imparted to the container and product.

23 Claims, 4 Drawing Sheets

CONTAINER WITH ENHANCED DISPLAY

CROSS-REFERENCE TO RELATED APPLICATIONS

The present application is a continuation of prior U.S. patent application Ser. No. 11/157,517, filed on Jun. 21, 2005 now U.S. Pat. No. 7,690,531, which has been allowed and which claims the benefit of PCT/US04/006992, filed Mar. 5, 2004, which claims the benefit of U.S. Provisional Application No. 60/455,942, filed Mar. 19, 2003, all of which are incorporated herein by reference in their entirety.

FIELD

This invention is directed to a dispensing container that has an enhanced appearance. More particularly, this invention is directed to a dispensing container where the dip tube is formed into a decorative shape, which shape optionally coordinates with a design on the front or rear of the bottle.

BACKGROUND

Dispensing containers with dip tubes are used to store and dispense a range of personal care products. These include hand soaps, hand and body lotions, shampoos and body cleansing gels. There is a constant need to enhance the appearance of these containers. In U.S. Pat. Nos. 5,937,554, 6,073,373 and 6,233,856 the appearance is enhanced by a decorative film material placed within the container. A design on this decorative film material coordinates with a design on the front and/or rear surface of the container. This gives a 3-D appearance. U.S. Pat. No. 5,915,600 discloses attaching a figurine to the dip tube of a dispensing container. And U.S. Pat. No. 6,276,566 discloses a cylindrical section surrounding the dip tube and depending from the cap area of container, this cylindrical section having a decoration thereon. The objective in each of these patents is to enhance the appearance of the container and the product in the container.

The present invention improves on the techniques of these patents to enhance the appearance of a container and its product. In the present invention, the dip tube is molded to contain a multi-dimensional design. This technique simplifies the manufacture of dip tubes that have an attached identifiable shape since the dip tube and identifiable shape are made in a single operation. This is in distinction to where the dip tube and multi-dimensional shape are separately made and then assembled.

BRIEF DESCRIPTION

The invention comprises a dispensing container having a body portion and a neck portion. A pump dispenser is supported by the neck portion and comprises a pump mechanism with a dip tube at one end and an exit channel at another end. The dip tube has an identifiable three-dimensional shape as an integral part of the dip tube. A preferred mode of making the three dimensional identifiable shape is by blowmolding. The three-dimensional identifiable shape can be that of a land animal, a sea animal, an air animal or an inanimate object.

The identifiable shape preferably is decorated as to color by a label. This can be by in-mold labeling or by placing a shrink film label over the identifiable shape and heat shrinking the label to the identifiable shape. The colors of the label will be coordinated to the colors needed for the identifiable shape. In the use of in-mold labeling, the dip tube is shaped to have an identifiable shape and colored in a single operation. When a shrink film colored label is used, only two in-line steps are needed.

This identifiable shape on the dip tube will coordinate with a design on front and/or rear label. This coordination yields a three dimensional effect by a label design on the front or rear surface of the container and the identifiable shape.

It also is a preferred embodiment where the refractive index of the liquid in the container and that of the dip tube be within about 0.6 of each other, and preferably about 0.4 In this embodiment the dip tube substantially disappears in the liquid except for the identifiable shape of the dip tube.

DETAILED DESCRIPTION OF THE INVENTION

Figure 1:
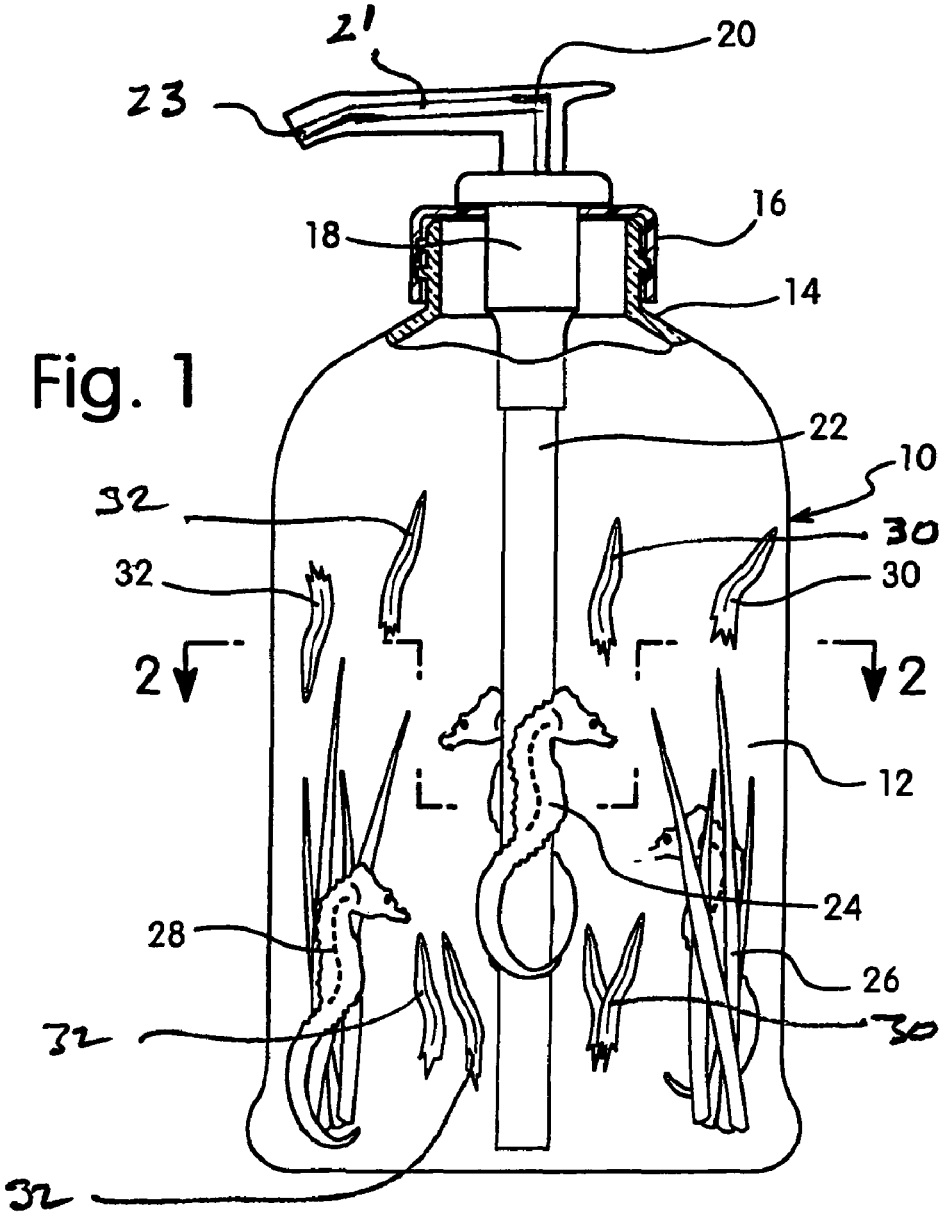
FIG. 1 is an elevation view of a dispensing container having a dip tube with an identifiable shape and a coordinating design on a front and rear label.

The invention will be disclosed in its preferred embodiments with reference to the Figures in the drawings. The dispensing container has an enhanced appearance using a highly efficient manufacturing process.

FIG. 1 shows dispensing container 10 with the enhanced appearance. The dispensing container is comprised of body portion 12 and neck portion 14. The neck portion has closure 16. Mounted in the closure is a pump mechanism 18 with dip tube 22 at one end and an actuator 20 with a dispensing channel 21. The dispensing channel has an exit at 23. When the pump is activated by dispensing activator 20, liquid in body portion 12 travels up dip tube 22, through the pump mechanism 18 and then through dispensing channel 21. The pump mechanism 18 is a conventional self priming pump mechanism well known in the art.

Figure 2:
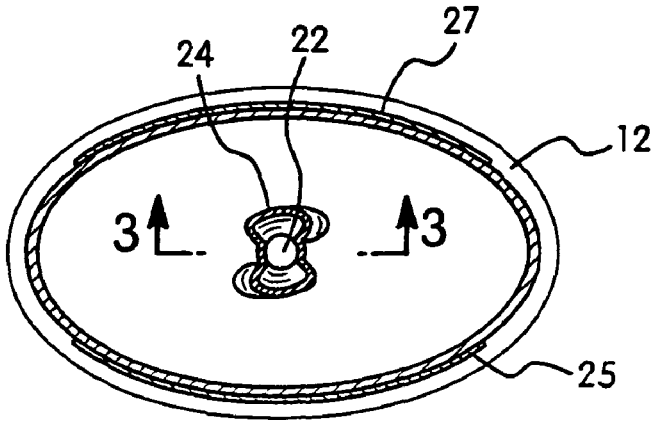
FIG. 2 is a cross-sectional view of the dispensing container of FIG. 1 along 2-2.

The dip tube has as a molded section with an identifiable shape 24 of a sea horse. This identifiable shape 24 is an integral part of the dip tube 22. This identifiable shape 24 can be formed at the same time as the dip tube is formed or in a subsequent operation. A preferred method of forming the dip tube 22 identifiable shape 24 is by blowmolding the identifiable shape 24 after the dip tube 22 has been extruded to an elongated form. Also shown in FIG. 1 are sea horses and a grass environment 26 and 28 as a front label 25 (see FIG. 2). Grass environment 30 and 32 are on the rear label 27 (see FIG. 2). FIG. 2 also shows the dip tube 22 in cross-section at the identifiable shape 24. The dip tube and the identifiable shape are substantially hollow.

Figure 3:
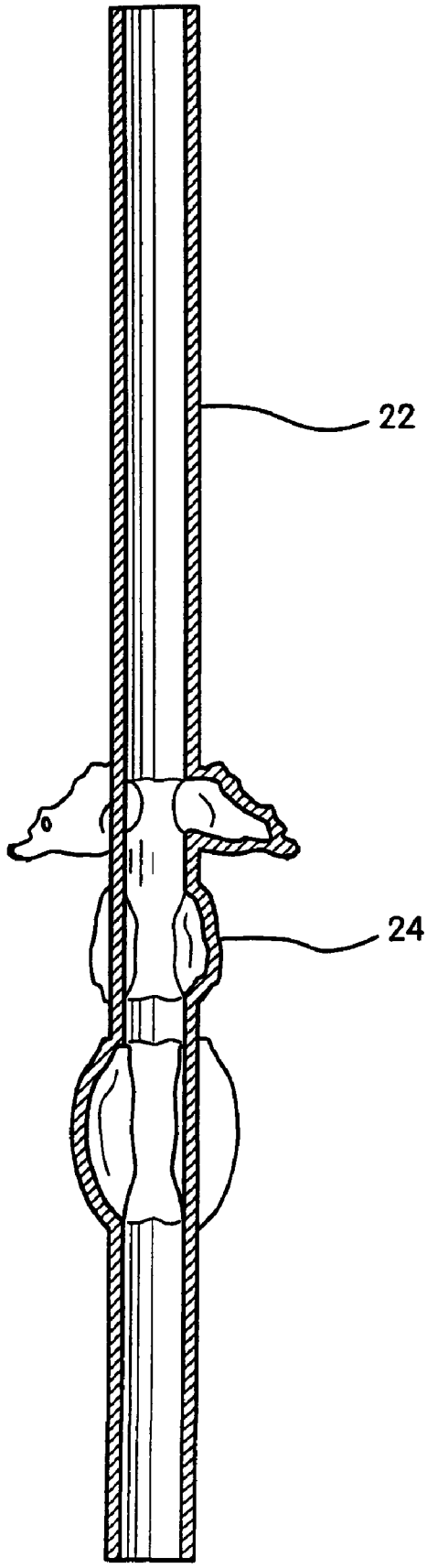
FIG. 3 is a vertical cross-section view of the dip tube.
Figure 4:
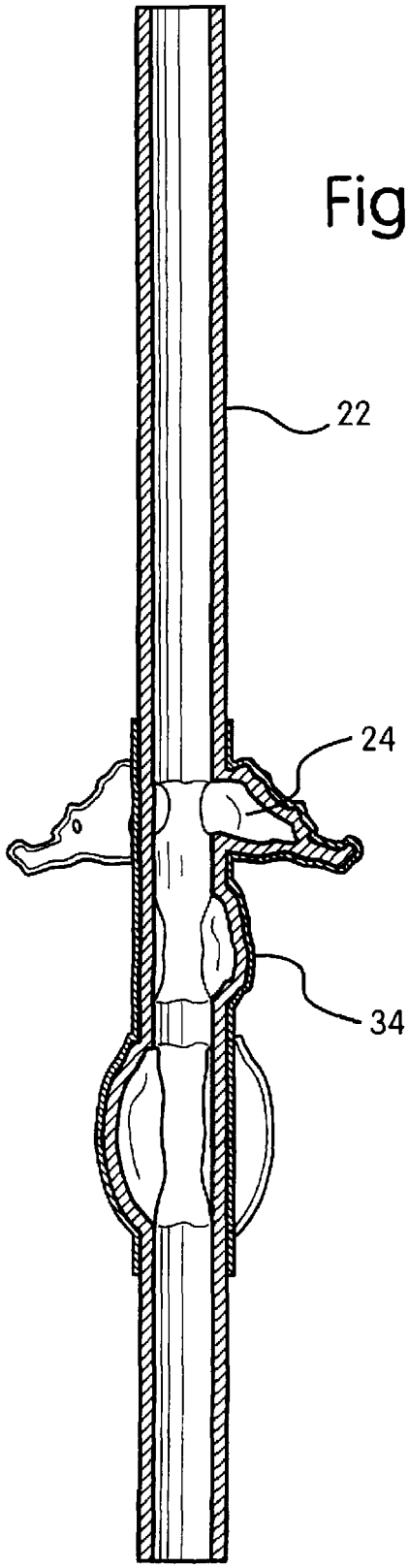
FIG. 4 is a vertical cross-section view of the dip tube of FIG. 3 with a decorative label over the identifiable shape.

FIG. 3 shows the dip tube 22 with the blow-molded identifiable shape in a vertical cross-section. In this embodiment, the identifiable shape is the same color as the dip tube. However, to have an impactful enhanced appearance, it must be colored to depict the true nature of the identifiable shape. Color can be applied to the identifiable shape in various ways, including hand painting. However, the use of a coordinated label is the most efficient and useful. The label colors will be coordinated with the colors for the identifiable shape, e.g.

brown for a bear, red for a cardinal bird and the like. The label can have the color on its exterior surface or the label can be a laminate with the color on a surface between the laminate layers. If on an exterior surface, it is preferred that it be on a surface adjacent to the identifiable shape, however it can be on the other surface. The objective would be to minimize the contact of the colors with the product within the container. The dip tube 22 is shown in FIG. 4 where the identifiable shape has a label 34 over the identifiable shape.

Figure 5:
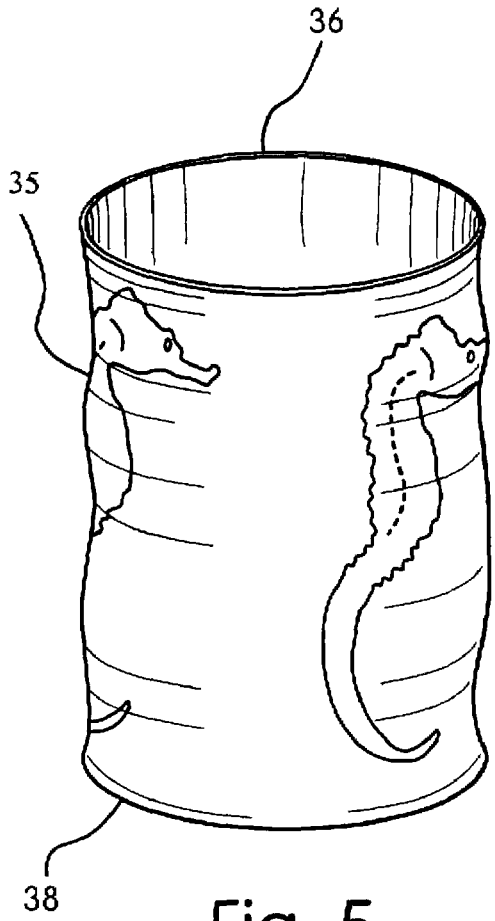
FIG. 5 is a perspective view of a cylindrical heat shrunk label.
Figure 6:
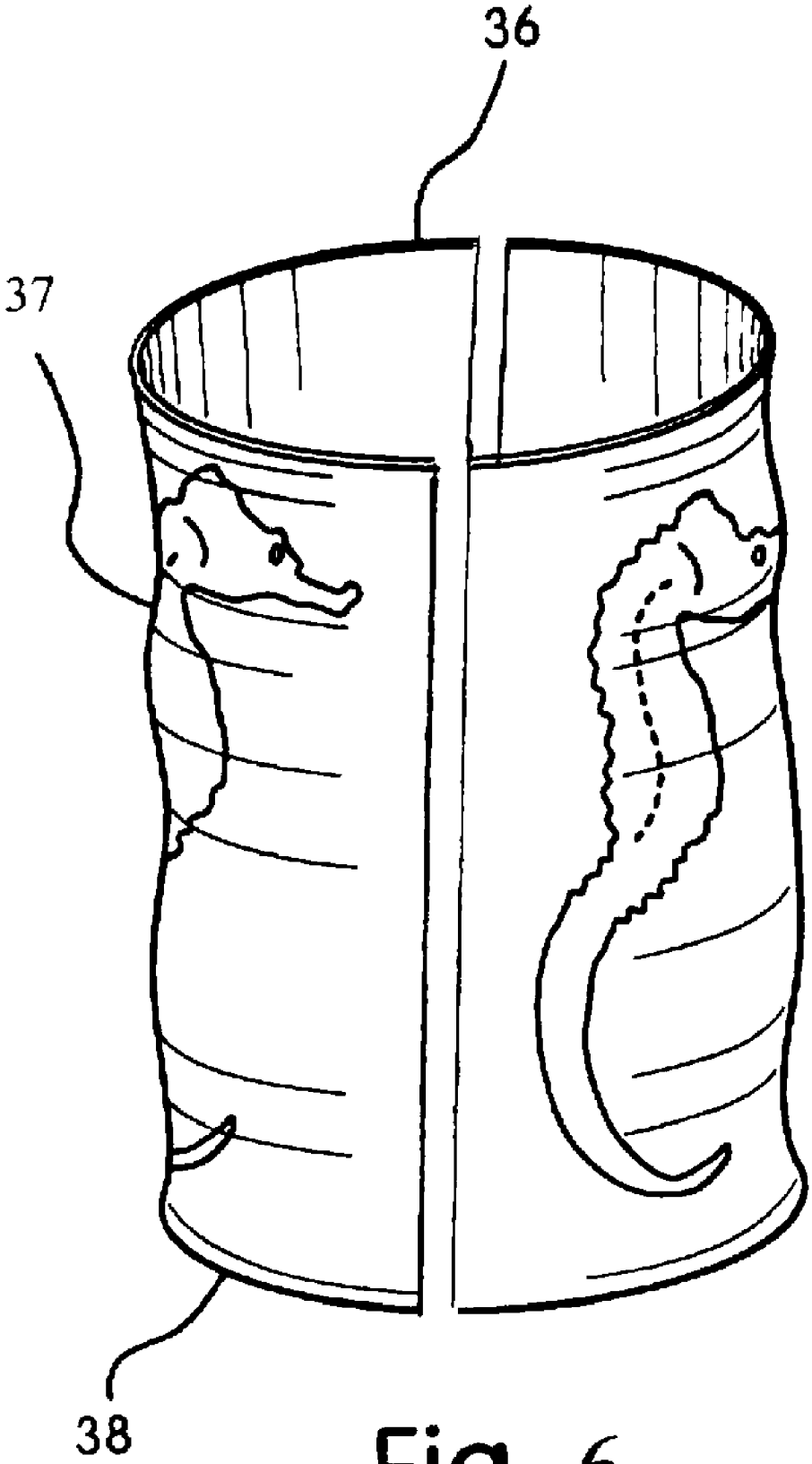
FIG. 6 is a perspective view of an identifiable shape with an in-mold label thereon.

Useful techniques for applying the label 34 to the identifiable shape 24, is through in-mold labeling or the use of a shrink film. A shrink film 34 is shown in FIG. 5. This is in the form of a tube and has open ends 36 and 38. There are different colors 40 and 42 on the label This shrink label is placed over the identifiable shape 24, coordinated so that the colors are in the proper place, and heated to shrink it tightly around the identifiable shape.

In the use of in-mold labeling, the label is placed in the mold and the identifiable shape blowmolded whereby the label bonds to the identifiable shape. This is an effective single step technique to form and color the identifiable shape.

The container will be substantially transparent, as will be the product liquid that is to be dispensed. This is necessary to readily view the identifiable shape. In this regard, the front label 25 will be substantially transparent where there is no design. The rear label can be opaque.

In a preferred embodiment, the contained liquid and the dip tube material will have a refractive index of within about 0.6, and preferably within about 0.4. In this way, the dip tube, except for the colored identifiable shape, will substantially disappear in the liquid.

The container can be made of essentially any substantially transparent plastic. Glass can also be used. Useful plastics are polyvinyl chloride and polyethylene terephthalate. The dip tube can be produced from any plastic that can be extruded and blowmolded. These can be polymers and copolymers of ethylene and propylene, vinyl compound polymers and copolymers and polyesters such as polyethylene terephthalate.

The unidentifiable shape and the dip tube will be made from a plastic material that can be extruded and blowmolded. The plastic preferably is a thermoplastic. Included in the plastics are ethylene, propylene and vinyl polymers and copolymers and polyesters such as polyethylene terephthalate. A useful vinyl polymer is polyvinyl chloride.

The front labels containing the decoration 26 and 28 and the rear label containing the decoration 30 and 32 can be any substantially clear plastic. The preferred plastics are thermoplastics. The preferred thermoplastics are polyvinyl chloride and polyethylene terephthalate. The decoration on the front and rear labels will be printed on to the labels. The in-mold label and the shrink film label can be comprised of a wide range of monolayer and laminate materials.

What is claimed is:

1. A container comprising:

a body portion;

a neck portion;

a pump dispenser on said neck portion, said pump dispenser comprising a pump mechanism;

a dip tube on a first end of said pump mechanism, said dip tube having a portion formed into an identifiable shape, said identifiable shape being of a three dimensional shape;

a pump outlet on a second end of said pump mechanism; and a shrink film on said identifiable shape, said shrink film having a color thereon and said container containing a liquid whereby the identifiable shape can be seen from an exterior of said container.

2. A container as in claim 1 wherein said shrink film has a plurality of colors on a surface adjacent to the identifiable shape.

3. A container as in claim 1 wherein said identifiable shape is blowmolded into said dip tube.

4. A container as in claim 1 wherein there is a design on one of a front surface of said container and a rear surface of said container, said design coordinating with said identifiable shape.

5. A container as in claim 1 wherein said identifiable shape is that of at least one of a sea animal, a land animal and an air animal.

6. A container as in claim 1 wherein said identifiable shape is that of an inanimate object.

7. A container as in claim 1 wherein a refractive index of a liquid in said container and of said dip tube is within about 0.6% of each other.

8. A container as in claim 1 wherein the shrink film is a laminate having laminate layers and wherein the color is on a surface between laminate layers so that the liquid does not directly contact the color.

9. A container as in claim 1 wherein said identifiable shape is molded into said dip tube.

10. A container as in claim 1 wherein the identifiable shape is an integral part of the dip tube.

11. A container as in claim 1 wherein said dip tube comprises a tubular body having an inner surface that defines a passageway through which said liquid in said container travels when said pump mechanism is activated, and wherein said identifiable shape is integral with the tubular body.

12. A container comprising:

a body portion;

a neck portion;

a pump dispenser on said neck portion, said pump dispenser comprising a pump mechanism;

a dip tube on a first end of said pump mechanism, said dip tube having a portion formed into an identifiable shape, said identifiable shape being of a three dimensional shape;

a pump outlet on a second end of said pump mechanism; and a film on said identifiable shape, said film having colors thereon to coordinate with the identifiable shape to enhance an appearance of said identifiable shape, and said container containing a liquid whereby the identifiable shape can be seen from an exterior of said container.

13. A container as in claim 12 wherein said colors on said film are on a surface adjacent to the identifiable shape.

14. A container as in claim 12 wherein said identifiable shape is blowmolded into said dip tube.

15. A container as in claim 12 wherein there is a design on one of a front surface of said container and a rear surface of said container, said design coordinating with said identifiable shape.

16. A container as in claim 12 wherein said identifiable shape is that of at least one of a sea animal, a land animal and an air animal.

17. A container as in claim 12 wherein said identifiable shape is that of an inanimate object.

18. A container as in claim 12 wherein a refractive index of a liquid in said container and of said dip tube is within about 0.6% of each other.

19. A container as in claim 12 wherein the film is a laminate having laminate layers and wherein the colors are on a surface between laminate layers so that the liquid does not directly contact the colors.

20. A container as in claim 12 wherein said identifiable shape is molded into said dip tube.

21. A container as in claim 12 wherein said film is one of a shrink film and an in-mold label.

22. A container as in claim 12 wherein the identifiable shape is an integral part of the dip tube.

23. A container as in claim 12 wherein said dip tube comprises a tubular body having an inner surface that defines a passageway through which said liquid in said container travels when said pump mechanism is activated, and wherein said identifiable shape is integral with the tubular body.

* * * * *